US011022139B2

(12) United States Patent
Froh et al.

(10) Patent No.: US 11,022,139 B2
(45) Date of Patent: Jun. 1, 2021

(54) FAN WHEEL AND RADIATOR FAN MODULE WITH THE FAN WHEEL

(71) Applicant: BROSE FAHRZEUGTEILE GMBH & CO. KOMMANDITGESELLSCHAFT, WUERZBURG, Wuerzburg (DE)

(72) Inventors: Christian Froh, Oldenburg (DE); Michael Mauss, Oldenburg (DE)

(73) Assignee: Brose Fahrzeugteile GmbH & Co. Kommanditgesellschaft, Wuerzburg, Wuerzburg (DE)

( * ) Notice: Subject to any disclaimer, the term of this patent is extended or adjusted under 35 U.S.C. 154(b) by 295 days.

(21) Appl. No.: 16/122,148

(22) Filed: Sep. 5, 2018

(65) Prior Publication Data

US 2019/0072105 A1 Mar. 7, 2019

(30) Foreign Application Priority Data

Sep. 5, 2017 (DE) ..... 10 2017 008 293.6

(51) Int. Cl.

| | |
|---|---|
| ***F04D 29/38*** | (2006.01) |
| ***F04D 29/32*** | (2006.01) |
| ***F04D 29/66*** | (2006.01) |
| ***F04D 25/06*** | (2006.01) |
| ***F04D 29/52*** | (2006.01) |

(Continued)

(52) U.S. Cl.

CPC ..... *F04D 29/386* (2013.01); *F01P 5/02* (2013.01); *F01P 5/04* (2013.01); *F04D 25/06* (2013.01); *F04D 29/324* (2013.01); *F04D 29/326* (2013.01); *F04D 29/329* (2013.01); *F04D 29/384* (2013.01); *F04D 29/522* (2013.01);

(Continued)

(58) Field of Classification Search

CPC ..... F04D 25/06; F04D 25/08; F04D 29/386; F04D 29/324; F04D 29/663; F04D 29/384; F04D 29/06; F04D 29/329; F04D 29/522; F04D 29/326; F04D 29/325; F04D 19/002; F01P 5/02; F01P 5/04; F01P 5/06; F01P 2005/046

See application file for complete search history.

(56) References Cited

U.S. PATENT DOCUMENTS

| | | | |
|---|---|---|---|
| 632,740 | A | 9/1899 | Parker |
| 2,684,723 | A | 7/1954 | Faber |

(Continued)

FOREIGN PATENT DOCUMENTS

| | | | |
|---|---|---|---|
| EP | 0887558 | A1 | 12/1998 |
| GB | 1491556 | A | 11/1977 |

(Continued)

*Primary Examiner* — Essama Omgba
*Assistant Examiner* — Christopher J Brunjes
(74) *Attorney, Agent, or Firm* — Laurence A. Greenberg; Werner H. Stemer; Ralph E. Locher

(57) ABSTRACT

A fan wheel has a hub cup and a plurality of blades extending radially outward from an outer wall of the hub cup, which is in particular at least substantially cylindrical. Each blade has a leading edge and a trailing edge, wherein for at least one blade, the progression of a relative position of the blade's leading edge and/or the progression of a relative position of the blade's trailing edge has an aperiodically wave-like shape. There is also described a radiator fan module with a fan wheel of the type described above, and a motor vehicle with such a radiator fan module.

17 Claims, 8 Drawing Sheets

(51) Int. Cl.
*F01P 5/02* (2006.01)
*F01P 5/04* (2006.01)
*F01P 5/06* (2006.01)

(52) U.S. Cl.
CPC ..... *F04D 29/663* (2013.01); *F01P 5/06* (2013.01); *F01P 2005/046* (2013.01)

(56) References Cited

U.S. PATENT DOCUMENTS

| | | | | |
|---|---|---|---|---|
| 3,416,725 | A | 12/1968 | Bohanon | |
| 5,906,179 | A | 5/1999 | Capdevila | |
| 6,579,063 | B2 | 6/2003 | Stairs et al. | |
| 9,970,453 | B2 | 5/2018 | Henner et al. | |
| 2003/0012656 | A1* | 1/2003 | Cho | F04D 29/326 416/235 |
| 2014/0056710 | A1* | 2/2014 | Henner | F04D 29/384 416/189 |
| 2017/0089322 | A1 | 3/2017 | Liu et al. | |
| 2018/0023578 | A1* | 1/2018 | Burtch | F04D 29/023 417/423.7 |

FOREIGN PATENT DOCUMENTS

| | | | |
|---|---|---|---|
| KR | 1020030044076 | A | 6/2003 |
| WO | 9837319 | A1 | 8/1998 |
| WO | 2012041565 | A1 | 4/2012 |
| WO | 2016103572 | A1 | 6/2016 |

* cited by examiner

FAN WHEEL AND RADIATOR FAN MODULE WITH THE FAN WHEEL

CROSS-REFERENCE TO RELATED APPLICATION

This application claims the priority, under 35 U.S.C. § 119, of German application DE 10 2017 008 293.6, filed Sep. 5, 2017; the prior application is herewith incorporated by reference in its entirety.

BACKGROUND OF THE INVENTION

Field of the Invention

The present invention relates to a fan wheel, in particular with backward-swept blades, for a radiator fan module, in particular an electrically operated radiator fan module, in particular for motor vehicles.

The cooling system of an internal combustion engine, in particular of a motor vehicle, mainly discharges the heat that is given off to the walls of combustion chambers and cylinders as a result of the combustion process not proceeding ideally. Because temperatures that are too high would damage the engine (tearing off the lubricating film, burning the valves, etc.), the internal combustion engine must be actively cooled.

Modern internal combustion engines, particularly four-stroke engines in motor vehicles, are with few exceptions liquid-cooled, typically using a mixture of water, antifreeze and corrosion inhibitor as a coolant.

The cooling liquid is pumped through the engine (cylinder head and engine block) via hoses, pipes and/or channels as well as, optionally, through highly thermally stressed components of the engine, such as the exhaust gas turbocharger, alternator or exhaust gas recirculation cooler. In the process, the cooling liquid absorbs heat energy and removes heat energy from the above-mentioned components. The heated cooling liquid then flows on to a radiator. The radiator—formerly often made of brass, today chiefly made of aluminum—is usually mounted on the front of the motor vehicle, where an air stream absorbs heat energy from the coolant and cools it before the coolant flows back to the engine; in this way, the coolant flows in a closed circuit.

To drive air through the radiator, a radiator fan module is furnished either in front of the radiator in the flow direction (i.e. upstream) or following the radiator (i.e. downstream), and may be driven mechanically via a belt drive or electrically via an electric motor. The following refers to an electrically driven radiator fan module.

A radiator fan module conventionally consists of a fan cowl, which has a fan wheel recess, and a fan wheel, which is rotatably held in the fan wheel recess.

The geometry of the fan wheel has a substantial effect on both the volume of air supplied and the acoustic properties of the radiator fan module.

The blades of conventional fan wheels (see FIGS. 1A and 1B) have an at least substantially flat or slightly curved edge geometry.

SUMMARY OF THE INVENTION

The primary object of the present invention is to provide an advantageous fan wheel that has particularly advantageous air supply properties and/or acoustic properties.

With the above and other objects in view there is provided, in accordance with the invention, a fan wheel, comprising:

a hub cup; and a plurality of blades arranged on said hub cup and extending radially outward from an outer wall of said hub cup;

each of said blades having a leading edge and a trailing edge;

wherein the following applies for at least one of said blades, or for some of said blades, or for all of said blades:

a reference line is defined by:

a first point on an axis of rotation of the fan wheel;

a radial extent through the first point and perpendicular to the axis of rotation; and a second point that bisects an arcuate edge into two equal sections at a transition from said hub cup to said blade, a reference plane is defined by a line displaced parallel to the axis of rotation and a line displaced parallel to said reference line, a displacement, as viewed in a direction of rotation of the fan wheel, being located entirely in front of said blade, wherein an orthogonal projection of said leading edge of said at least one blade and an orthogonal projection of said trailing edge of said at least one blade are mapped in the reference plane;

wherein a z-axis is defined in the reference plane by an orthogonal projection of the axis of rotation in the reference plane, which is displaced parallel outward in a radial direction in the reference plane from the orthogonal projection of the axis of rotation around an outer radius of said hub cup;

wherein a y-axis is defined in the reference plane by an orthogonal projection of the radial extent in the reference plane;

wherein a relative unit radius t(r) is plotted on the y-axis, and is defined as follows:

$$t(r) = \frac{r - R_i}{R_a - R_i}$$

wherein $R_i$ is an outer radius of said hub cup;

$R_a$ is an outer radius of said at least one blade; and r is a distance between the axis of rotation and a sectional plane under consideration, which is at distance r perpendicular from the axis of rotation on the associated reference line, wherein $r \in [R_i; R_a]$ wherein a relative position of said leading edge $POS_{rel_VK}$ and/or a relative position of said trailing edge $POS_{rel_HK}$ is plotted on the z-axis; and wherein a progression of the relative position of said leading edge $POS_{rel_VK}(t)$ and/or a progression of the relative position of said trailing edge $POS_{rel_HK}(t)$ has an aperiodically wave-like shape.

According to the invention, the objective is achieved by means of a fan wheel, in particular for a motor vehicle, having: a hub cup that in particular is rotationally symmetrical around an axis of rotation; and a plurality of blades which are arranged on the hub cup and extend radially outwardly from an outer wall of the hub cup that is in particular at least substantially cylindrical, each blade having a leading edge and a trailing edge, wherein for at least one blade, in particular some of the blades, and in particular all blades, the following applies: a reference line is defined by a first point on an axis of rotation of the fan wheel, a radial extent passing through the first point and perpendicular to the axis of rotation, and a second point that bisects an arcuate edge into two equal sections at the transition from the hub cup to the blade; and a reference plane is defined by a line displaced parallel to the axis of rotation and a line displaced parallel to the reference line, the displacement being such that, viewed in the direction of rotation of the fan wheel, it is located entirely in front of the blade, wherein an orthogonal projection of the leading edge of the blade and an orthogonal projection of the trailing edge of the blade are mapped in the reference plane; a z-axis is defined in the reference plane by an orthogonal projection of the axis of rotation in the reference plane, which is displaced parallel outward in the radial direction in the reference plane from the orthogonal projection of the axis of rotation around an outer radius of the hub cup; in the reference plane a y-axis is defined by an orthogonal projection of the radial extent in the reference plane; and a relative unit radius t is plotted on the y-axis, and is defined as follows:

$$t(r) = \frac{r - R_i}{R_a - R_i}$$

wherein $R_i$ is an outer radius of the hub cup, which corresponds in particular at least substantially to an inner radius of the blade; $R_a$ is an outer radius of the blade; and r is the distance between the axis of rotation and the sectional plane under consideration, which is perpendicular at distance r from the axis of rotation on the associated reference line, wherein $r \in [R_i; R_a]$, and wherein the progression of the relative position of the leading edge $POS_{rel_VK}(t)$ and/or the progression of the relative position of the trailing edge $POS_{rel_HK}(t)$ have an aperiodically wave-like shape.

This is particularly advantageous according to an embodiment of the present invention, because it makes possible a favorable air volume flow. Comparative measurements, which are explained in detail in the description of the drawings, have shown that a fan wheel according to the present invention may achieve, and in particular does achieve, a higher air volume flow than an otherwise identically constructed fan having a flat or curved trailing edge. In other words: According to the present invention, the same air volume flow may be generated with less power or a slower running fan wheel. Alternatively, a higher air volume flow may be achieved at the same power.

A "fan wheel" in the meaning of the present invention is in particular a rotationally symmetric component with a hub, in particular a hub cup, that connects the fan wheel to a motor, in particular via a shaft protruding from the motor in such a way that the torque the motor generates is at least substantially completely transferred to the fan wheel. In addition, the fan wheel has a plurality of blades, which are furnished, and in particular set up, to generate an air volume flow as soon as the fan wheel is put into rotational movement. The blades are preferably inclined relative to the axis of rotation in an angular range from −90° to +90°.

A "hub cup" in the meaning of the present invention is in particular a central part of the fan wheel, and is arranged at least substantially in the center of the fan, and provides a connection to a drive, in particular a motor, in particular an electric motor, and at least partially covers this drive, in particular motor, in particular electric motor; and which, like a conventional cup, comprises an at least substantially flat base surface and an adjoining cylindrical surface. In particular, the blades are arranged on, and in particular integrally molded to, this cylindrical outer wall.

A "blade" in the meaning of the present invention is a flat body inclined relative to a plane to which the axis of rotation is perpendicular, which is arranged on the hub cup and is furnished, and in particular set up, to generate an air volume flow as soon as the fan wheel is put into a rotational motion. In the meaning of the present invention, "blades" also refers, in particular, to vanes or rotor blades.

A "leading edge" of the blade in the meaning of the present invention is in particular the edge that is first in the direction of rotation.

A "trailing edge" of a blade in the meaning of the present invention is in particular the edge of the blade that lags behind, when viewed in the direction of rotation.

An "orthogonal projection" in the meaning of the present invention is a mapping of a point onto a plane, so that the line connecting the point and its mapping forms a right angle with this plane. The mapping then has the shortest distance of all points of the plane to the starting point. The orthogonal projection is thus a special case of a parallel projection, in which the direction of projection is the same as the normal direction to the plane.

A "relative unit radius" in the meaning of the present invention describes a point or a plane, in particular a cylindrical plane, at a defined distance from the axis of rotation in a normalized manner, which improves comparability between different fan wheels.

The term "aperiodic" refers in particular to a shape that extends asymmetrically over the relative unit radius; in other words, there is no axis of symmetry that bisects the progression of the relative position of the leading edge $POS_{rel_VK}(t)$ and/or the progression of the relative position of the trailing edge $POS_{rel_HK}(t)$ into two identical subfunctions. In other words: The progression of the relative position of the leading edge $POS_{rel_VK}(t)$ and/or the progression of the relative position of the trailing edge $POS_{rel_HK}(t)$ is not a function with values that repeat at regular intervals.

A "wave-like" shape in the meaning of the present invention is characterized in particular by the fact that the second derivative of the underlying function is always continuous.

In other words, the basic idea of the present invention is to give the leading edge and/or the trailing edge an aperiodically wave-like shape, which leads to a unique configuration of the blade, as has been described over the edge geometry (the progression of the relative position of the leading or trailing edge). This shape according to the invention is the key to increased air performance and the above-described performance savings.

According to one embodiment of the present invention, the relative position of the leading edge $POS_{rel_VK}(t)$ is referenced to a third point which, viewed in the direction of rotation of the fan wheel, is the foremost point at the transition from the hub cup to the blade, and/or the relative position of the trailing edge $POS_{rel_HK}(t)$ is referenced to a fourth point, which is the rearmost point at the transition from the hub cup to the blade, viewed in the direction of rotation of the fan wheel. This is particularly advantageous because in this way the relative position of the leading and/or trailing edge is referenced to a defined point in order to be able from the relative position to determine an absolute position based on the third and/or fourth point.

According to an additional embodiment of the present invention, the fan wheel has one or a plurality of backward-swept blades viewed in the direction of rotation. This is particularly important because there are fundamentally different aerodynamic conditions for fan wheels with forward and backward-swept blades, which have, among other things, a significant influence on the air volume flow that is supplied. "Backward-swept" in the meaning of the present invention means in particular that the tip of the blade with outer radius $R_a$ lags behind, when viewed in the direction of rotation of the center of the blade.

According to a preferred embodiment of the present invention, the fan wheel has an at least substantially circular outer ring, which connects the tips of the blades together. This is particularly advantageous because in this way an increased mechanical strength of the fan wheel is achieved and a defined, at least substantially constant, gap is provided between a cowl ring and the outer ring, which in turn leads to advantageous aerodynamic and/or acoustic effects.

According to an embodiment of the present invention, the progression of the relative position of the trailing edge $POS_{rel_HK}(t)$ has a maximum, and in particular a local maximum, in the range of 80% to 100%, in particular 90% to 100%, in particular 92.5% to 97.5%, of the relative unit radius t(r) of the blade (30). This is particularly advantageous because extensive experimental studies have shown that a maximum, in particular a local maximum, in the specified range contributes a substantial component to the increase in the air volume flow.

According to one embodiment of the present invention, the progression of the relative position of the leading edge $POS_{rel_VK}(t)$ has a minimum, in particular a local minimum, in the range of 80% to 100%, in particular 90% to 100%, in particular 92.5% to 97.5%, of the relative unit radius t(r) of the blade (30). This is particularly advantageous because extensive experimental studies have shown that a minimum, in particular a local minimum, in the specified range contributes a substantial component to the increase in the air volume flow.

According to an additional embodiment of the present invention, the progression of the relative position of the trailing edge $POS_{rel_HK}(t)$ has no or at most one low point in the y-direction after the, in particular local, maximum. This is particularly advantageous, because in this way the fan wheel runs at least substantially linearly, inasmuch as extensive experiments have shown that additional waves after the maximum, in particular local maximum, do not achieve any further significant power savings.

According to an additional embodiment of the present invention, the progression of the relative position of the leading edge $POS_{rel_VK}(t)$ has no or at most one high point in the y-direction after the, in particular local, minimum. This is particularly advantageous, because in this way the fan wheel runs at least substantially linearly, inasmuch as extensive experiments have shown that additional waves after the minimum, in particular local minimum, do not achieve any further significant power savings.

According to an additional embodiment of the present invention, the progression of the relative position of the leading edge $POS_{rel_VK}(t)$ and the progression of the relative position of the trailing edge $POS_{rel_HK}(t)$ are at least substantially axisymmetric to each other, and in particular the trailing edge $POS_{rel_HK}(t)$ extends in a range around a curve mirrored geometrically exactly on the axis of symmetry that is +/−20%, in particular +/−10%, of the value of the relative position of the leading edge $POS_{rel_VK}(t)$. In particular, the axis of symmetry corresponds to a line, in particular a horizontal line, having the following property:

$$POS_{rel}(t)=0$$

This is particularly advantageous because extensive experiments have shown that an at least substantially axisymmetric progression of a leading and trailing edge relative to each other yields particularly positive results.

In other words: A curved pivot axis extends centrally or slightly eccentrically, for example, at 40% of the blade extent in the direction of rotation, through the blade, and incremental slices of the blade, which are perpendicular to the pivot axis, are individually oriented around this pivot axis. This results, via the pivot axis, in a functional relationship between the progression of the relative position of the leading edge $POS_{rel_VK}(t)$ and the progression of the relative position of the trailing edge $POS_{rel_HK}(t)$.

According to an additional embodiment of the present invention, the progression of the relative position of the leading edge $POS_{rel_VK}(t)$, as a function of the relative unit radius t(r), satisfies the following condition:

$$POS_{rel_VK}(t) = \frac{-(A_1t^2 + A_2t)\cos[2\pi N(a(1-t)+1)(t+t_0)] + A_3t + A_4}{R_a - R_i}$$

where:

$t_0 \in [0; 0, 5]$, in particular $t_0 \in [0; 0, 25]$, in particular $t_0 \in [0; 0, 1]$ $N \in [1; 8]$, in particular $N \in [2; 5]$, in particular $N \in [2; 4]$ $a \in [-1, 5; 1, 5]$, in particular $a \in [-1, 0; 1, 0]$, in particular $a \in [-0, 5; 0, 5]$ $A_1 \in [-10; 10]$, in particular $A_1 \in [-8; 8]$, in particular $A_1 \in [-5; 5]$ $A_2 \in [-10; 10]$, in particular $A_2 \in [-8; 8]$, in particular $A_2 \in [-5; 5]$ $A_3 \in [-10; 10]$, in particular $A_3 \in [-8; 8]$, in particular $A_3 \in [-5; 5]$; and $A_4 \in [-10; 10]$, in particular $A_4 \in [-8; 8]$, in particular $A_4 \in [-5; 5]$.

The term $t_0$ describes an offset of the relative unit radius for setting the vertex at the hub cup, N describes the number of oscillations over the axial unit radius, a describes an oscillation coefficient for scaling the wavelength and setting the position of the, in particular local, minimum, $A_1$ describes a quadratic polynomial coefficient, $A_2$ describes a linear polynomial coefficient, $A_3$ describes an axial threading coefficient, i.e. for adjusting the linear progression of the leading edge from the hub cup to the blade tip or outer ring, and $A_4$ describes a relative base deflection ("start" deflection) of the leading edge of the hub cup. The above-mentioned function describes the aperiodically wave-like shape of the progression of the relative position of the leading edge $POS_{rel_VK}(t)$. By using the specified parameters, it is possible to adapt the progression of the relative position of the leading edge $POS_{rel_VK}(t)$ to external conditions in the course of fan wheel construction, in order thus to achieve an advantageous power savings or an equivalent increase in air volume flow.

According to an additional embodiment of the present invention, the progression of the relative position of the trailing edge $POS_{rel_HK}(t)$, as a function of the relative unit radius t(r), satisfies the following condition:

$$POS_{rel_HK}(t) = \frac{(A_1t^2 + A_2t)\cos[2\pi N(a(1-t)+1)(t+t_0)] + A_3t + A_4}{R_a - R_i}$$

where:

$t_0 \in [0; 0, 5]$, in particular $t_0 \in [0; 0, 25]$, in particular $t_0 \in [0; 0, 1]$ -continued $N \in [1; 8]$, in particular $N \in [2; 5]$, in particular $N \in [2; 4]$ $a \in [-1, 5; 1, 5]$, in particular $a \in [-1, 0; 1, 0]$, in particular $a \in [-0, 5; 0, 5]$ $A_1 \in [-10; 10]$, in particular $A_1 \in [-8; 8]$, in particular $A_1 \in [-5; 5]$ $A_2 \in [-10; 10]$, in particular $A_2 \in [-8; 8]$, in particular $A_2 \in [-5; 5]$ $A_3 \in [-10; 10]$, in particular $A_3 \in [-8; 8]$, in particular $A_3 \in [-5; 5]$; and $A_4 \in [-10; 10]$, in particular $A_4 \in [-8; 8]$, in particular $A_4 \in [-5; 5]$.

The term $t_0$ describes an offset of the relative unit radius for setting the vertex at the hub cup, N describes the number of oscillations over the axial unit radius, a describes an oscillation coefficient for scaling the wavelength and setting the position of the, in particular local, maximum, $A_1$ describes a quadratic polynomial coefficient, $A_2$ describes a linear polynomial coefficient, $A_3$ describes an axial threading coefficient, i.e. for adjusting the linear progression of the trailing edge from the hub cup to the blade tip or outer ring, and $A_4$ describes a relative base deflection ("start" deflection) of the trailing edge of the hub cup. The above-mentioned function describes the aperiodically wave-like shape of the progression of the relative position of the trailing edge $POS_{rel_HK}(t)$. By using the specified parameters, it is possible to adapt the progression of the relative position of the trailing edge $POS_{rel_HK}(t)$ to the external conditions in the progression of fan wheel design, in order thus to achieve an advantageous power savings or an equivalent increase in air volume flow.

The fan wheel according to the invention, according to one of the embodiments described herein, is particularly contemplated for use in conjunction with a fan cowl with front struts, that is, the struts are in front of the fan when viewed in the main flow direction.

A further aspect of the present invention relates to a radiator fan module, in particular for a motor vehicle, having a fan cowl, a fan wheel recess formed in the fan cowl, wherein the fan wheel recess is bounded by a cowl ring, a motor holder which is arranged inside the fan wheel recess and which is mechanically connected with the fan cowl via struts, a motor, in particular an electric motor, which is at least partially held in the motor holder, and a fan wheel, which is arranged in the fan wheel recess and is rotationally driven by the motor, wherein the fan wheel is formed according to an embodiment of the present invention.

A "radiator fan module" in the meaning of the present invention is in particular an assembly which, when viewed in the flow direction, is arranged before or after a radiator of a vehicle and which is furnished, and in particular adapted, to generate an air volume flow which passes through or around the radiator, wherein the air volume flow receives thermal energy from the radiator.

A "fan cowl" in the meaning of the present invention is in particular a frame in which the fan wheel is held, and in turn is preferably arranged, and in particular fastened, on or near a radiator. A fan cowl according to the present invention preferably has a plastic material, in particular a plastic compound; in particular, the fan cowl is formed therefrom. Additionally and/or alternatively, the fan cowl has a metal material, for example iron, steel, aluminum, magnesium or the like, and in particular is at least partially, in particular at least substantially, in particular completely, formed therefrom. According to one embodiment, a fan cowl may also have more than one fan wheel recess, one motor holder, one motor and one fan wheel; in particular, the present invention is suitable for use in radiator fan modules with two or more, in particular two, fan wheels. According to one embodiment, the fan cowl additionally has at least one closable opening, in particular at least one flap, in particular a plurality of flaps. This is particularly advantageous because further air-guiding properties may be realized in this way.

A "fan wheel recess" in the meaning of the present invention is in particular a material recess within the fan cowl. In the fan wheel recess according to an embodiment of the present invention, struts extend which mechanically, in particular mechanically and electrically and/or electronically, connect a motor holder that is also arranged in the fan wheel recess with the fan cowl. According to the present invention, the fan wheel recess is bounded by a cowl ring.

A "cowl ring" within the meaning of the present invention limits the fan wheel recess to a plane perpendicular to the axis of rotation of the fan wheel, wherein the plane is at least substantially identical, in particular, with the extension direction of the fan cowl. The cowl ring may be formed by an edge of the fan wheel recess and/or may have a cylinder extending in the axial direction, which is preferably formed integrally with the fan cowl.

A "motor holder" within the meaning of the present invention is in particular a device for mechanically fastening the motor to the fan cowl, in particular for providing the torque acting opposite the fan wheel. According to one embodiment, the motor holder is an at least substantially ring-shaped structure in which the motor is held. This is particularly advantageous because in this way an advantageous cooling air flow is not affected by the motor.

"Struts" in the meaning of the present invention are in particular beam-shaped or sickle-shaped structures which provide a mechanical connection between the motor holder and the fan cowl. By way of example, the struts may have a drop-shaped cross-section in order to achieve advantageous aerodynamic and/or acoustic effects.

A "motor" in the meaning of the present invention is in particular a machine that performs mechanical work by converting a form of energy such as thermal/chemical or electrical energy, into kinetic energy, in particular torque. This is particularly advantageous because in this way the fan cowl may be operated at least substantially independently, except for the supply of energy, that is, without an external supply of kinetic energy, such as via a fan belt or timing belt.

An "electric motor" in the meaning of the present invention is an electromechanical converter (electric machine), which converts electrical power into mechanical power, in particular into torque. The term "electric motor" in the meaning of the present invention comprises, but is not limited to, direct current motors, alternating current motors and three-phase motors or brush and brushless electric motors, or internal rotor and external rotor motors. This is particularly advantageous because electrical energy is an energy form, by means of which the required torque is provided to drive the fan wheel, that is easy to transfer compared to mechanical or chemical energy.

To avoid repetition, for the advantages of a radiator fan module designed in such a way, reference is made to the above statements.

According to one embodiment of the present invention, the struts of the radiator fan module are arranged in front of the fan wheel when viewed in the flow direction. This is particularly relevant, because front and rear struts lead to substantially different aerodynamic conditions and the fan wheel described herein may be used particularly advantageously in front struts, as extensive experiments have shown.

A further aspect of the present invention relates to the use of a fan wheel of the type described herein, or a radiator fan module of the type described herein, in a motor vehicle. This is particularly important, because the type of fan wheel described herein has a particularly advantageous effect with the external conditions at the installation site.

Other features which are considered as characteristic for the invention are set forth in the appended claims.

Although the invention is illustrated and described herein as embodied in a fan wheel and radiator fan module with such fan wheel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
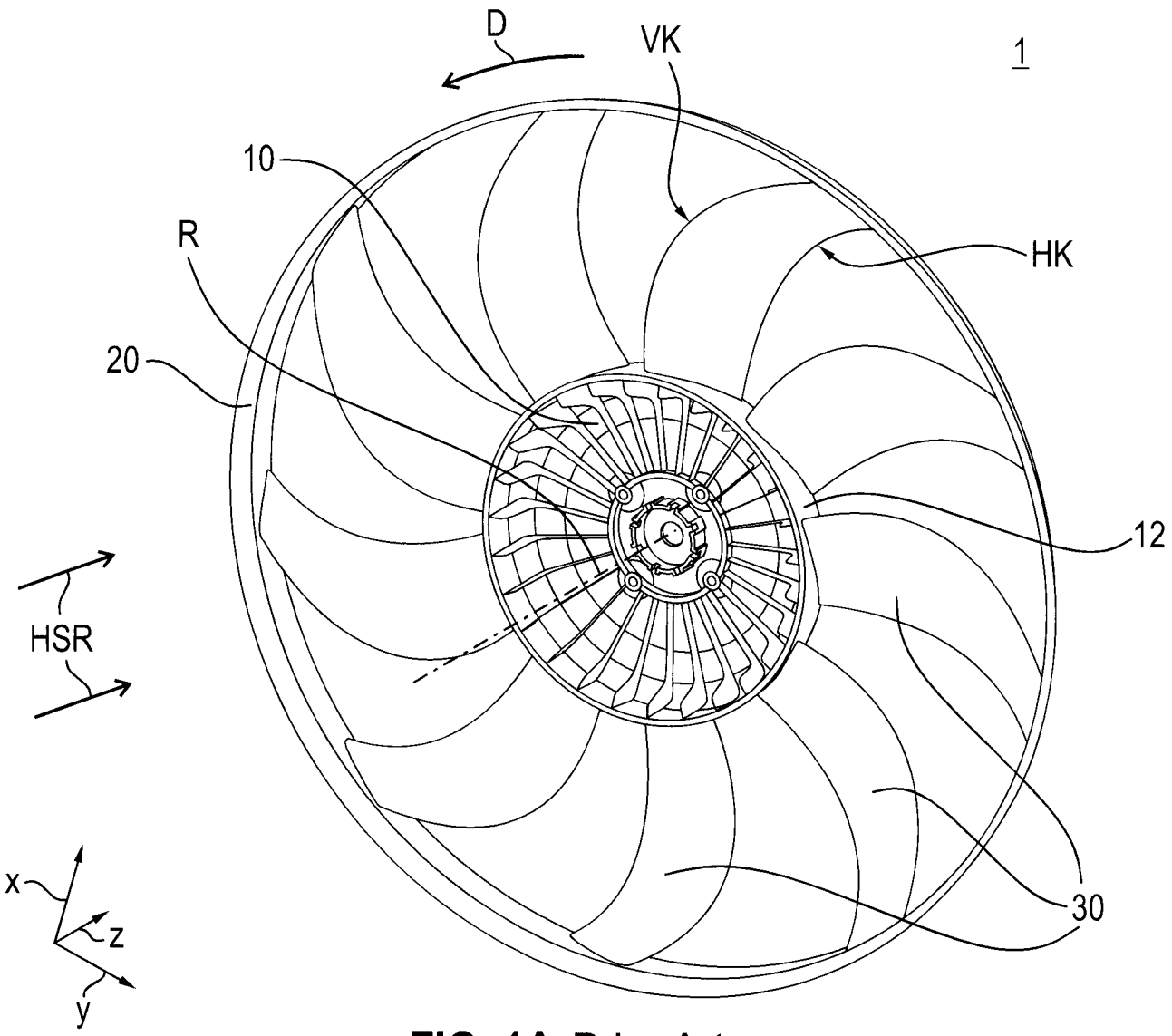
FIG. 1A Prior Art
FIG. 1A shows a fan wheel of the prior art in a perspective view of the upper side.
Figure 1B:
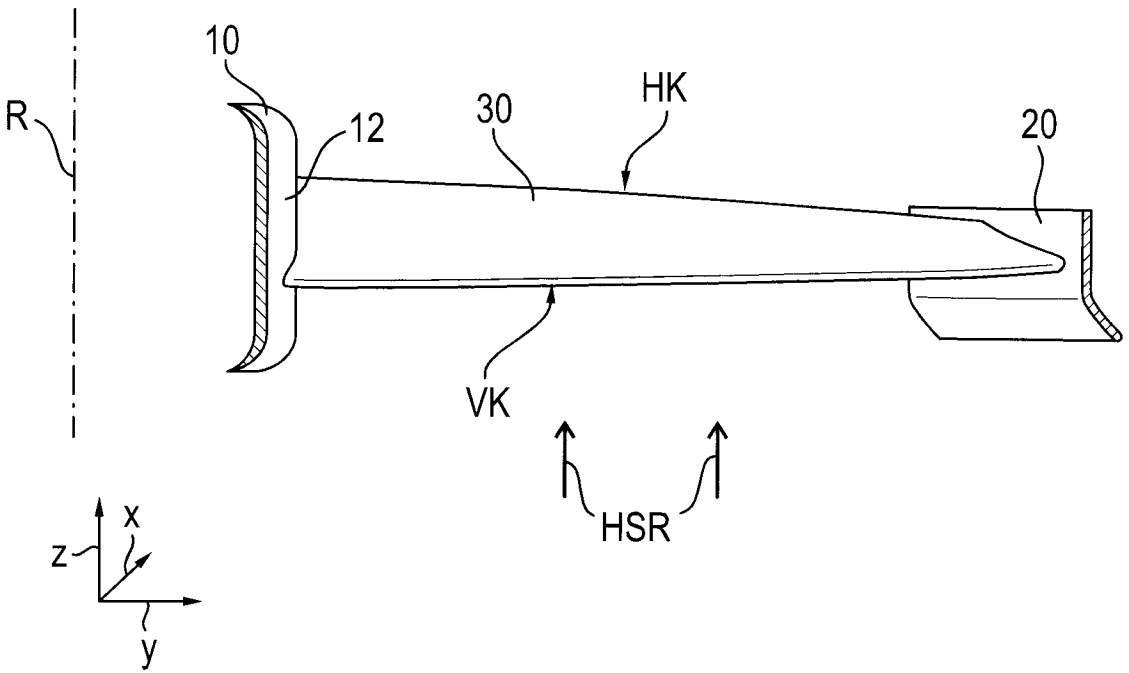
FIG. 1B Prior Art
FIG. 1B shows a front view of a blade of the fan wheel known in the art from FIG. 1A, viewed from the reference plane in a perspective view, with the upper side of the fan wheel facing downward.

Referring now to the figures of the drawing in detail and first, particularly, to FIGS. 1A and 1B, there is shown in FIG. 1A a prior art fan wheel 1 in a perspective view from the upper side and in FIG. 1B a front of a blade 30 of the prior art fan wheel from the reference plane in a perspective view, with the upper side (corresponding to the suction side) of the fan wheel 1 pointing downwards.

According to FIGS. 1A, 1B, 2A, 2B and 3, the fan wheel 1 has a hub cup 10 which is rotationally symmetrical about an axis of rotation R. At the hub cup 10, a plurality of blades 30 are arranged, which extend radially outward from a cylindrical outer wall 12 of the hub cup 10. A direction of rotation D is indicated by an arrow in FIGS. 1A and 2A. Accordingly, the direction of rotation is counterclockwise. A main flow direction of the supplied air is marked with HSR. The fan wheel 1 has an at least substantially circular outer ring 20 which links the tips of the blades 30 together.

With regard to FIG. 1B (and FIG. 2B), it should be noted that the position of the axis of rotation R, with regard to its distance from the cylindrical outer wall 12 of the hub cup 10 or the inner edge of the blade 30 (characterized by the points P3 and P4), is not true to scale; in other words, the orientation is binding, but the position is not.

As may be seen in FIGS. 1A and 1B, the prior art blades 30 have flat or curved leading edges VK and flat or curved trailing edges HK in an orthogonal projection.

Figure 2A:
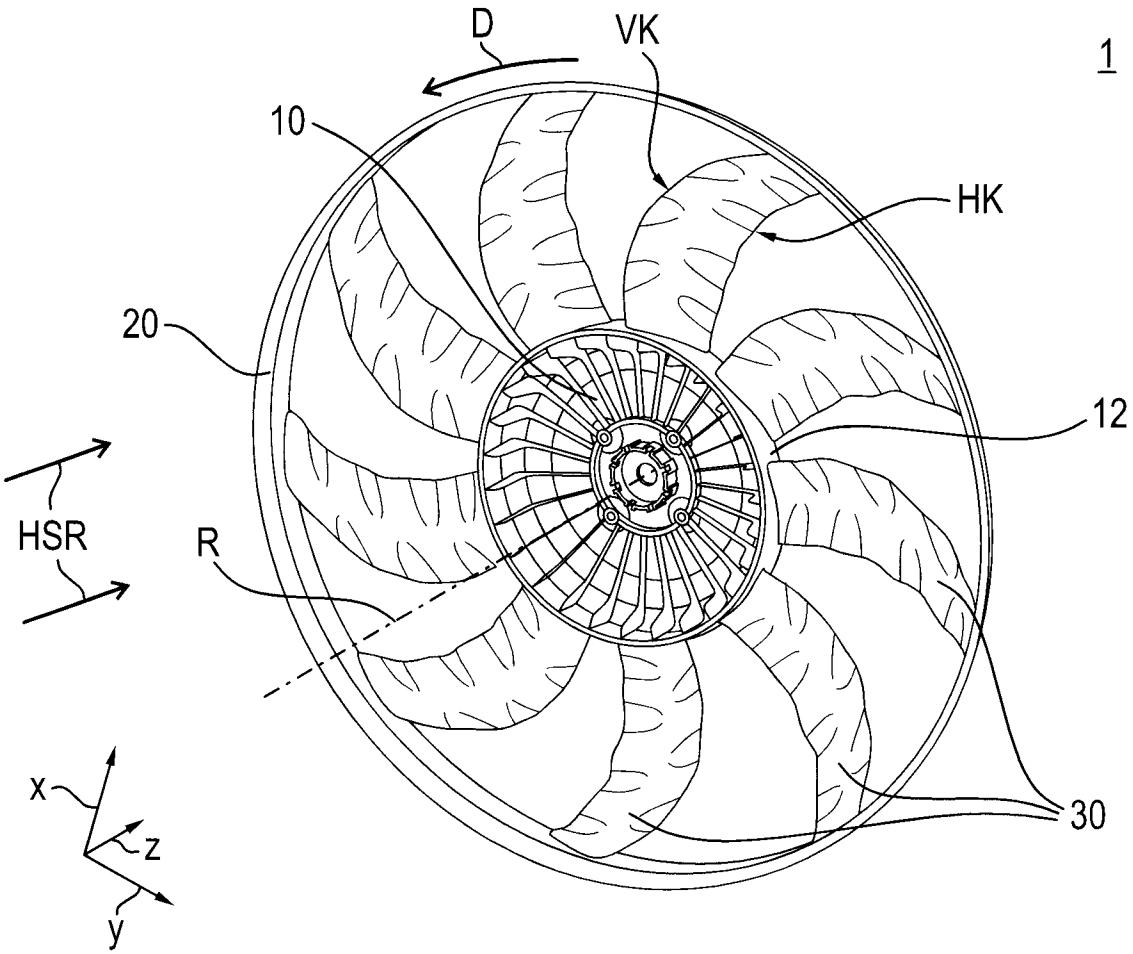
FIG. 2A shows a fan wheel according to an embodiment of the present invention in a perspective view from the upper side.
Figure 2B:
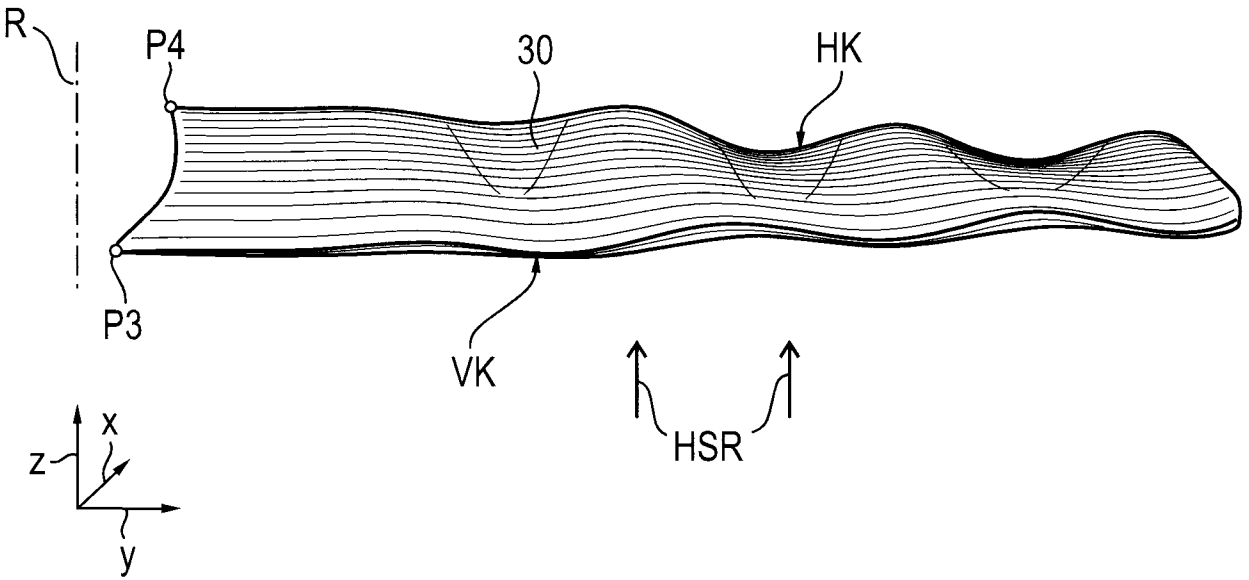
FIG. 2B shows a front view of a blade of the fan wheel of FIG. 2A viewed from the reference plane in a perspective view, with the upper side of the fan wheel facing downward.

FIG. 2A shows a fan wheel 1 according to one embodiment of the present invention in a perspective view, and FIG. 2B shows a front view of a blade 30 of the fan wheel of FIG. 2A viewed from the reference plane E_REF, in a perspective view.

Compared to embodiments of a fan wheel 1 according to the prior art (see FIGS. 1A and 1B), the fan wheel 1 according to an embodiment of the present invention as shown in FIGS. 2A, 2B has blades 30 with an aperiodic wave-shaped trailing edge HK.

Figure 3:
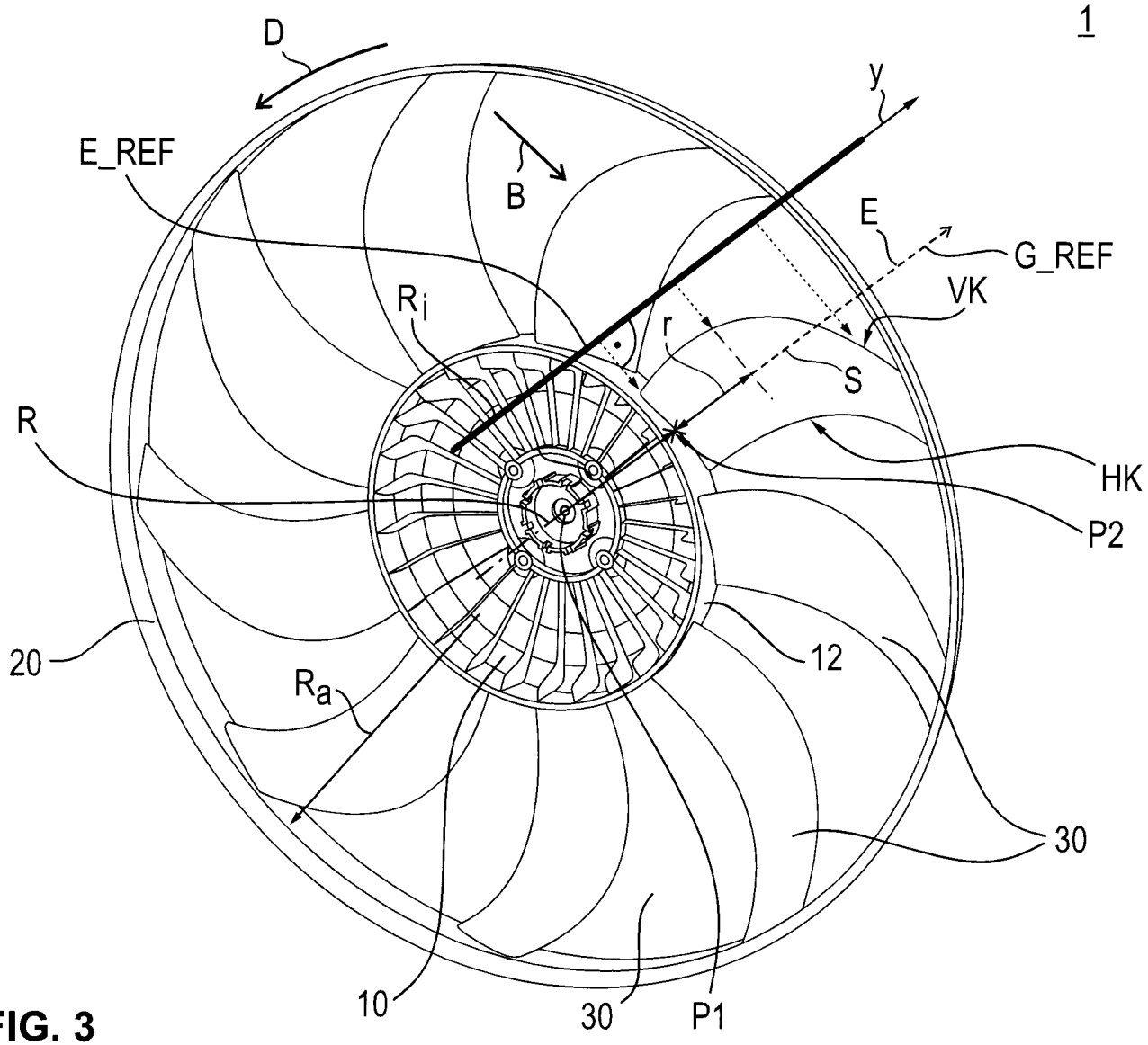
FIG. 3 shows a fan wheel of the prior art in a perspective view for illustrating a reference plane.

As regards the perspective of the sectional view, reference is made to the following statements regarding FIG. 3.

FIG. 3 shows a fan wheel 1 from the prior art in a perspective view for illustrating a reference plane E_REF.

In the following, the viewing plane for the description of the leading edge VK and trailing edge HK will be defined. The fan wheel shown in FIG. 3 does not have any blade geometry according to this invention, which is not relevant to the description of the reference plane E_REF, because the statements relevant thereto apply in the same way for embodiments of the invention.

Starting from the axis of rotation R, a reference line G_REF is defined by a first point P1 on the axis of rotation R of the fan wheel 1, a radial extent E is defined by the first point P1, perpendicular to the axis of rotation R, and a second point P2, which bisects an arcuate edge at the transition from the hub cup 10 to the blade 30 into two equal sections. In other words: The radius is determined that passes through the point P2. The point P2 represents the center of the transition edge from hub cup 10 to blade 30, in particular from the edge of the blade 30 facing the bottom of the cup. Another at least substantially identical definition of P2 may be derived via an angle: Two auxiliary radii are required, the first auxiliary radius passing through P1 and a third point P3 on the transitional edge between the cylindrical outer wall and the blade, and a second auxiliary radius passing through a fourth point P4 on the transitional edge from the hub cup 10 to the blade 30, and the line is constructed that bisects the angle enclosed between the two auxiliary radii. The point at which the aforementioned bisector intersects the cylindrical outer wall 12, in particular at an outer side thereof, is P2. Starting from G_REF, a reference plane E_REF is defined by a line displaced parallel to the axis of rotation R and a line displaced parallel to the reference line G_REF, the displacement being such that, viewed in the direction of rotation D of the fan wheel 1, it is located entirely in front of the blade 30, On the reference plane E_REF are mapped an orthogonal projection of the leading edge VK of the blade 10 and an orthogonal projection of the trailing edge HK of the blade 10. The viewing direction B shows the view in FIGS. 1B and 2B respectively of a blade segment of the fan wheel 1.

A coordinate system consisting of a z-axis and y-axis is spanned in the reference plane E_REF. This is significant for the description of the progression of the relative position of the leading edge $POS_{rel_VK}(t)$ and the progression of the relative position of the trailing edge $POS_{rel_HK}(t)$. The z-axis is defined by an orthogonal projection of the axis of rotation R in the reference plane E_REF, which in a second step is displaced in parallel outward in the reference plane E_REF in the radial direction from the orthogonal projection of the axis of rotation R about an outer radius $R_i$ of the hub cup 10. In other words: The z-axis is unchanged in orientation, but is displaced in parallel in two steps, i.e. a first time through orthogonal projection onto the reference plane E_REF and then through displacement by $R_i$ in the reference plane E_REF. This means that the z-axis passes through the orthogonal projection of P2 onto E_REF. The y-axis is defined through an orthogonal projection of the radial extent E in the reference plane E_REF. The origin of this y-z coordinate system is defined by the intersection of the two axes.

A relative unit radius t(r) is plotted on the y-axis, and is defined as follows:

$$t(r) = \frac{r - R_i}{R_a - R_i}$$

wherein

- $R_i$ is an outer radius of the hub cup 10, which corresponds in particular at least substantially to an inner radius of the blade 30;
- $R_a$ is an outer radius of the blade 30; and
- r is the distance between the axis of rotation R and the sectional plane S under consideration, which is perpendicular at the distance r perpendicular from the axis of rotation R along the associated reference line G_REF, where $r \in [R_i; R_a]$.

Figure 4:
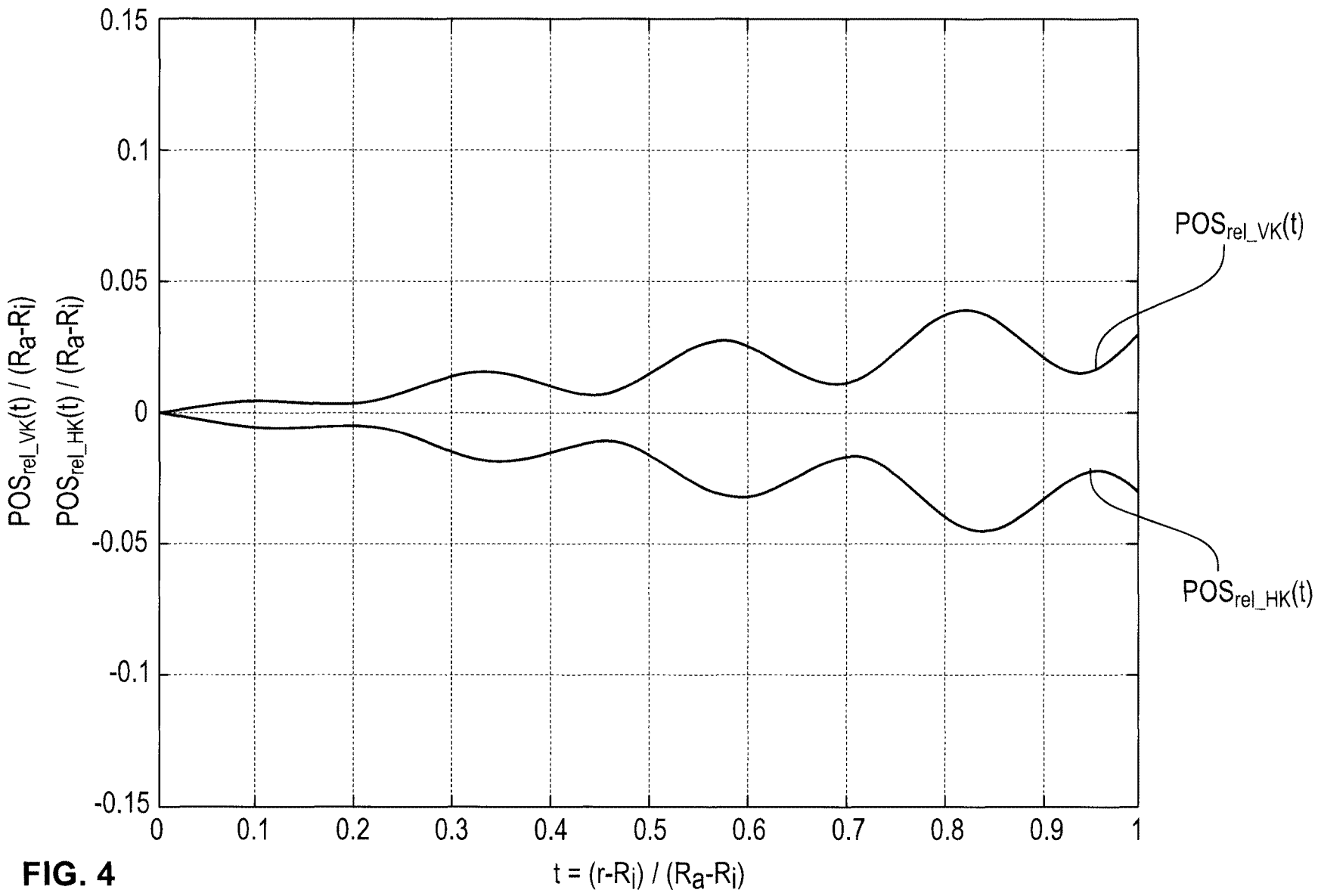
FIG. 4 shows the progression of the relative position of the leading edge $POS_{rel_VK}(t)$ and the relative position of the trailing edge $POS_{rel_HK}(t)$ over the relative unit radius of a fan wheel according to an embodiment of the present invention.

FIG. 4 shows the progression of the relative position of the leading edge $POS_{rel_VK}(t)$ and the relative position of the trailing edge $POS_{rel_HK}(t)$ over the relative unit radius of a fan wheel according to an embodiment of the present invention.

The horizontal axis corresponds to the y-axis described above, and the vertical axis corresponds to the z-axis described above. The relative unit radius t(r) is plotted on the horizontal axis.

The progression of the relative position of the leading edge $POS_{rel_VK}(t)$ and the progression of the relative position of the trailing edge $POS_{rel_HK}(t)$ are respectively plotted on the vertical axis in standardized form.

The relative position of the leading edge $POS_{rel_VK}(t)$ is given by $$POS_{rel_VK}(t) = \frac{-(A_1 t^2 + A_2 t)\cos[2\pi N(a(1-t)+1)(t+t_0)] + A_3 t + A_4}{R_a - R_i}$$

and the relative position of the trailing edge $POS_{rel_HK}(t)$ is given by $$POS_{rel_HK}(t) = \frac{(A_1 t^2 + A_2 t)\cos[2\pi N(a(1-t)+1)(t+t_0)] + A_3 t + A_4}{R_a - R_i}$$

wherein respectively $t_0$ describes an offset of the relative unit radius for setting the vertex at the hub cup, N describes the number of oscillations over the axial unit radius, a describes an oscillation coefficient for scaling the wavelength and setting the position of the, in particular local, extremum (i.e. minimum for the leading edge, maximum for the trailing edge), $A_1$ describes a quadratic polynomial coefficient, $A_2$ describes a linear polynomial coefficient, $A_3$ describes an axial threading coefficient, i.e. for adjusting the linear progression of the leading or trailing edge from the hub cup to the blade tip or outer ring, and $A_4$ describes a relative base deflection ("start" deflection) of the leading or trailing edge of the hub cup. The functions described above describe the aperiodic wave-like shape of the progression of the relative position of the leading edge $POS_{rel_VK}(t)$ and the trailing edge $POS_{rel_HK}(t)$.

It will be apparent that the progression of the relative position of the trailing edge $POS_{rel_HK}(t)$ has a maximum, in particular a local maximum, in the range of 80% to 100%, in particular 90% to 100%, in particular 92.5% to 97.5%, of the relative unit radius t(r) of the blade (30), and the progression of the relative position of the leading edge $POS_{rel_VK}(t)$ has a minimum, in particular a local minimum, in the range of 80% to 100%, in particular 90% to 100%, in particular 92.5% to 97.5%, of the relative unit radius t(r) of the blade (30).

As may also be seen from the exemplary embodiment of FIG. 4, the progression of the relative position of the trailing edge $POS_{rel_HK}(t)$ in the y-direction has no or at most one low point after the, in particular local, maximum, and/or the progression of the relative position of the leading edge $POS_{rel_VK}(t)$ in the y direction has no or at most one high point after the, in particular local, minimum.

As may also be seen from FIG. 4, the progression of the relative position of the leading edge $POS_{rel_VK}(t)$ and the progression of the relative position of the trailing edge $POS_{rel_HK}(t)$ are at least substantially axisymmetric to each other, and in particular the trailing edge $POS_{rel_HK}(t)$ extends around a geometrically unambiguously determined progression of a reflected curve in a range that is +/−20%, in particular +/−10%, of the value of the relative position of the leading edge $POS_{rel_VK}(t)$.

In the exemplary embodiment of FIG. 4, the progression of the relative position of the leading edge $POS_{rel_VK}(t)$, as a function of the relative unit radius t(r), satisfies the following condition:

$$POS_{rel_VK}(t) = \frac{-(A_1 t^2 + A_2 t)\cos[2\pi N(a(1-t)+1)(t+t_0)] + A_3 t + A_4}{R_a - R_i}$$

where:

$t_0 \in [0; 0,5]$ $N \in [1; 8]$ $a \in [-1,5; 1,5]$ $A_1 \in [-10; 10]$ $A_2 \in [-10; 10]$ $A_3 \in [-10; 10]$ and $A_4 \in [-10; 10]$.

In the exemplary embodiment of FIG. 4, the progression of the relative position of the trailing edge $POS_{rel_HK}(t)$, as a function of the relative unit radius t(r), satisfies the following condition:

$$POS_{rel_HK}(t) = \frac{(A_1t^2 + A_2t)\cos[2\pi N(a(1-t)+1)(t+t_0)] + A_3t + A_4}{R_a - R_i}$$

where:

$t_0 \in [0; 0, 5]$ $N \in [1; 8]$ $a \in [-1, 5; 1, 5]$ $A_1 \in [-10; 10]$ $A_2 \in [-10; 10]$ $A_3 \in [-10; 10]$ and $A_4 \in [-10; 10]$.

The progression of the relative position of the leading edge $POS_{rel_VK}(t)$ shown in FIG. 4 results at least substantially, in particular absolutely, from the following parameters:

$t_0$=0.04
N=4
a=0
$A_1$=0
$A_2$=2
$A_3$=4
and
$A_4$=0

The progression of the relative position of the trailing edge $POS_{rel_HK}(t)$ shown in FIG. 4 results at least substantially, in particular absolutely, on the basis of the following parameters:

$t_0$=0.04
N=4
a=0
$A_1$=0
$A_2$=2
$A_3$=−5
and
$A_4$=0

Figure 5:
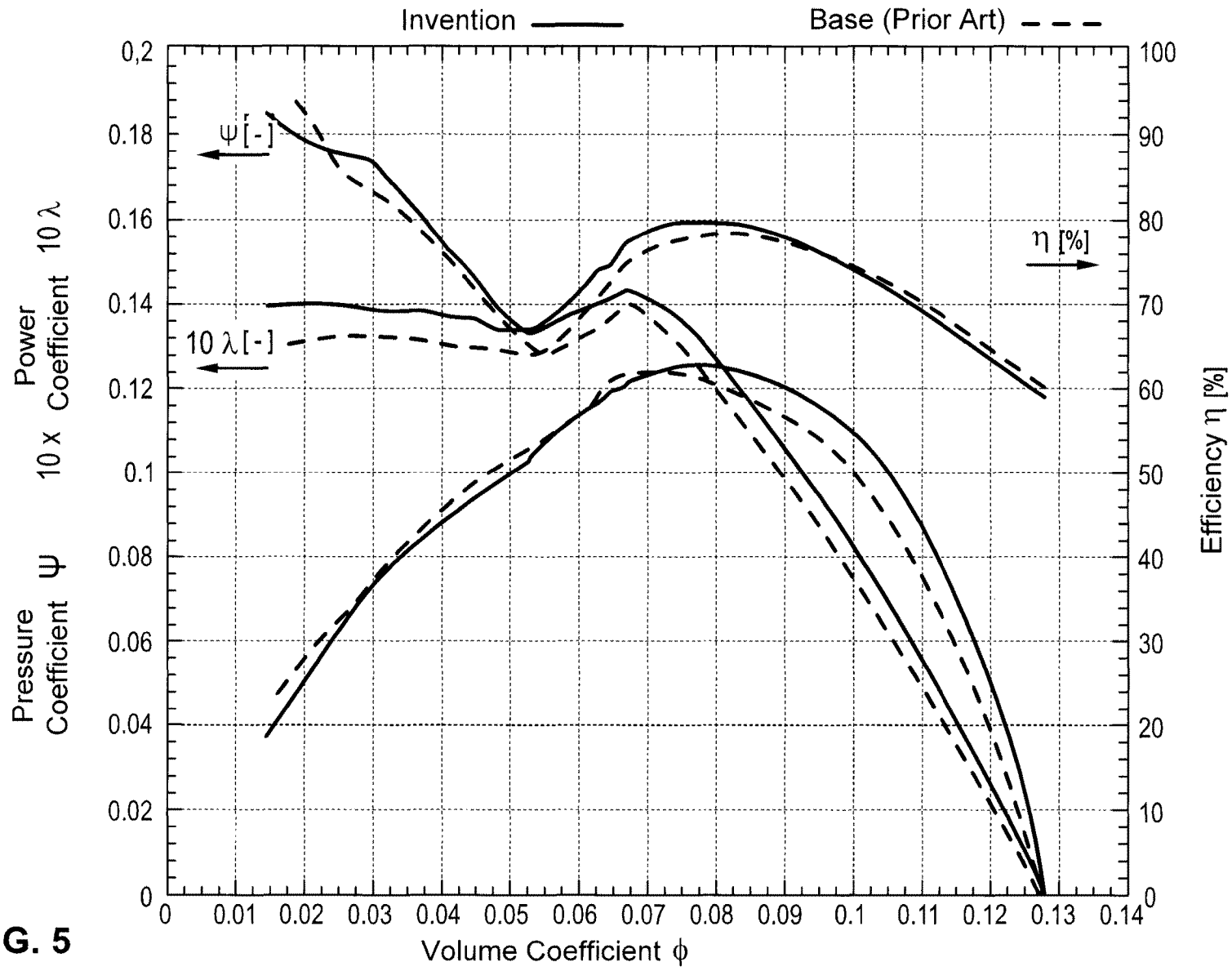
FIG. 5 shows a comparison of a fan wheel previously known in the art with a fan wheel according to an embodiment of the present invention.

FIG. 5 shows a comparison of a fan wheel 1 previously known in the art with a fan wheel 1 according to an embodiment of the present invention.

There are shown:

a pressure coefficient ψ, which describes the total pressure gradient generated by the fan wheel between the upstream and downstream sides as a dimensionless characteristic independent of the effective fan wheel diameter $D_W$, the air density ρ and the rotational speed n, the total pressure gradient $\Delta p_t$ generated by the fan wheel (consisting of static and dynamic components) between the upstream and downstream side of the same:

$$\psi = \frac{2\Delta p_t}{\pi^2 \rho D_w^2 n^2}$$

a coefficient of performance λ, which describes an input power ρ as a dimensionless characteristic, independent of the effective fan wheel diameter $D_W$, the air density $P_{wel}$ and the rotational speed n:

$$\lambda = \frac{8P_{wel}}{\pi^4 \rho D_w^5 n^3}$$

For the input power $P_{wel}$, here the shaft power of the electric motor is used; corresponding losses (heat, friction, etc.) of the electric motor are not taken into account.

There is also shown:

a total efficiency η, which relates the input power $P_{wel}$ to the generated total pressure gradient $\Delta p_t$ across the supplied volumetric flow $\dot{V}$.

$$\eta = \frac{\Delta p_t \dot{V}}{P_{wel}}$$

On the x-axis of the diagram, a volume coefficient φ is plotted, which describes the supplied volumetric flow $\dot{V}$ as a dimensionless characteristic, independent of the effective fan wheel diameter DW and the rotational speed n:

$$\varphi = \frac{4\dot{V}}{\pi^2 D_w^3 n}$$

In other words: The indicated characteristic numbers are nondimensionalized with pi π, the air density ρ in kg/m$^3$, the effective diameter ($D_W$=2$R_a$) in m and the rotational speed n in 1/s. In this way, comparability with non-identical fan wheels is provided for.

As is apparent, with almost the same performance (similar coefficient of performance) a higher pressure coefficient (=>total pressure increase) is achieved, yielding a significant increase in efficiency in the relevant volume coefficient range.

Figure 6:
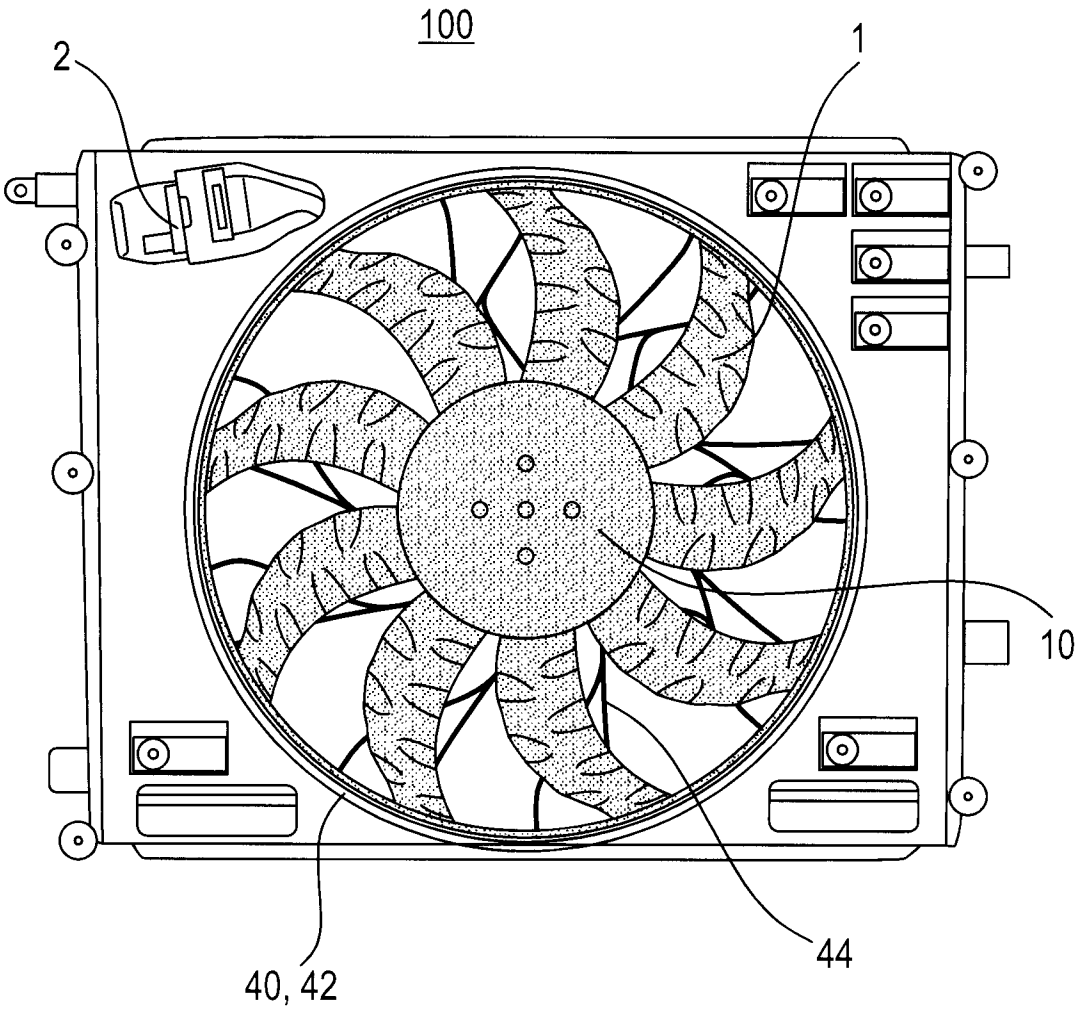
FIG. 6 shows a radiator fan module with the fan wheel according to the present invention, according to the second aspect of the present invention.

FIG. 6 shows a radiator fan module 100 with the fan wheel 1 according to the present invention, according to the second aspect of the present invention.

The radiator fan module 100 has a fan cowl 2; a fan wheel recess 40 is formed in the fan cowl 2, and is bounded by a cowl ring 42. A motor holder (hidden by the hub cup 10) is arranged within the fan wheel recess 40 and is mechanically connected with the fan cowl 2 via struts 44. A motor (likewise hidden by the hub cup 10), in particular an electric motor, is at least partially held in the motor holder. A fan wheel 1 is arranged in the fan wheel recess 40 and is driven rotationally by the motor. The fan wheel 1 corresponds to an embodiment of a fan wheel 1 according to the present invention. The detailed configuration of the fan wheel 1 has been described above. According to the embodiment of FIG. 6, the struts 44 are arranged before the fan wheel in the flow direction, with the flow direction running perpendicularly out from the illustration of FIG. 6.

Although exemplary embodiments have been explained in the foregoing specification, it should be noted that numerous modifications are possible. In particular, such a configuration of the fan cowl according to the invention is also suitable for dissipating waste heat from components of a purely electrically powered vehicle. It should additionally be noted that the exemplary embodiments are merely examples that are not intended to limit the scope, applications and structure in any way. Rather, the preceding description gives the person of ordinary skill in the art a guide for implementing at least one exemplary embodiment, and various changes, in particular with regard to the function and arrangement of the components described, may be made without departing from the scope of the patent, as set forth in the Claims and equivalent feature combinations.

The following is a summary list of reference numerals and the corresponding structure used in the above description of the invention:

1 Fan wheel
2 Cowl
10 Hub cup
12 (Cylindrical) outer wall of the hub cup 10
20 Outer ring
30 Blade
40 Fan wheel recess
42 Cowl ring
44 Struts
100 Radiator fan module
HK Trailing edge
VK Leading edge
B Line of vision
D Direction of rotation
E Radial extent
E_REF Reference plane
G_REF Reference line
HSR Main flow direction
P1 First point
P2 Second point
P3 Third point
P4 Fourth point
$POS_{rel_VK}(t)$ Relative position of the leading edge
$POS_{rel_HK}(t)$ Relative position of the trailing edge
r Distance between axis of rotation R and section plane S
R Axis of rotation
$R_a$ Outer radius of the blade 30
$R_i$ Outer radius of the hub cup 10
S Section plane
y y-axis
z z-axis

The invention claimed is:

1. A fan wheel, comprising:

a hub cup; and a plurality of blades arranged on said hub cup and extending radially outward from an outer wall of said hub cup;

each of said blades having a leading edge and a trailing edge;

wherein the following applies for at least one of said blades, or for some of said blades, or for all of said blades:

a reference line is defined by:

a first point on an axis of rotation of the fan wheel;

a radial extent through the first point and perpendicular to the axis of rotation; and a second point that bisects an arcuate edge into two equal sections at a transition from said hub cup to said blade, a reference plane is defined by a line displaced parallel to the axis of rotation and a line displaced parallel to said reference line, a displacement, as viewed in a direction of rotation of the fan wheel, being located entirely in front of said blade, wherein an orthogonal projection of said leading edge of said at least one blade and an orthogonal projection of said trailing edge of said at least one blade are mapped in the reference plane;

wherein a z-axis is defined in the reference plane by an orthogonal projection of the axis of rotation in the reference plane, which is displaced parallel outward in a radial direction in the reference plane from the orthogonal projection of the axis of rotation around an outer radius of said hub cup;

wherein a y-axis is defined in the reference plane by an orthogonal projection of the radial extent in the reference plane;

wherein a relative unit radius t(r) is plotted on the y-axis, and is defined as follows:

$$t(r) = \frac{r - R_i}{R_a - R_i}$$

wherein $R_i$ is an outer radius of said hub cup;

$R_a$ is an outer radius of said at least one blade; and r is a distance between the axis of rotation and a sectional plane under consideration, which is at distance r perpendicular from the axis of rotation on the associated reference line, wherein $r \in [R_i; R_a]$ wherein a relative position of said leading edge $POS_{rel_VK}$ and/or a relative position of said trailing edge $POS_{rel_HK}$ is plotted on the z-axis;

wherein a progression of the relative position of said leading edge $POS_{rel_VK}(t)$ and/or a progression of the relative position of said trailing edge $POS_{rel_HK}(t)$ has an aperiodically wave-like shape;

wherein the progression of the relative position of said leading edge $POS_{rel_VK}(t)$ and the progression of the relative position of said trailing edge $POS_{rel_HK}(t)$ are axisymmetric to each other; and wherein said trailing edge $POS_{rel_HK}(t)$ extends in a range around a geometrically determined progression of a reflected curve that is +/−20% of a value of the relative position of said leading edge $POS_{rel_VK}(t)$.

2. The fan wheel according to claim 1, wherein:

said hub cup is at least substantially cylindrical and rotationally symmetrical around an axis of rotation of the fan wheel; and $R_i$ is the outer radius of said hub cup and an inner radius of said at least one blade.

3. The fan wheel according to claim 1, wherein the relative position of said leading edge $POS_{rel_VK}(t)$ is referenced to a third point that is a forward-most point in the direction of rotation of the fan wheel at a transition from said hub cup to said blade; and/or the relative position of said trailing edge $POS_{rel_HK}(t)$ is referenced to a fourth point, which is a rearward-most point in the direction of rotation of the fan wheel at the transition from the hub cup to said blade.

4. The fan wheel according to claim 1, wherein said blade, viewed in the direction of rotation, is a backward-swept blade.

5. The fan wheel according to claim 1, further comprising a substantially circular outer ring disposed to link respective tips of said plurality of blades together.

6. The fan wheel according to claim 1, wherein:

the progression of the relative position of said trailing edge $POS_{rel_HK}(t)$ has a maximum in a range of 80% to 100% of the relative unit radius t(r) of said blade;

and/or the progression of the relative position of said leading edge $POS_{rel_VK}(t)$ has a minimum in a range of 80% to 100% of the relative unit radius t(r) of said blade.

7. The fan wheel according to claim 6, wherein:

the progression of the relative position of said trailing edge $POS_{rel_HK}(t)$ has the maximum in a range of 90% to 100% of the relative unit radius t(r) of said blade;

and/or the progression of the relative position of said leading edge $POS_{rel_VK}(t)$ has the minimum in a range of 90% to 100% of the relative unit radius t(r) of said blade.

8. The fan wheel according to claim 7, wherein:

the progression of the relative position of said trailing edge $POS_{rel_HK}(t)$ has a local maximum in a range of 92.5% to 97.5% of the relative unit radius t(r) of said blade; and/or the progression of the relative position of said leading edge $POS_{rel_VK}(t)$ has a local minimum in a range of 92.5% to 97.5% of the relative unit radius t(r) of said blade.

9. The fan wheel according to claim 6, wherein:

the progression of the relative position of said trailing edge $POS_{rel_HK}(t)$ has no low points or at most one low point in the y-direction after maximum in a radial direction; and/or the progression of the relative position of said leading edge $POS_{rel_VK}(t)$ has no high points or at most one high point in the y-direction after the minimum in the radial direction.

10. The fan wheel according to claim 1, wherein said trailing edge $POS_{rel_HK}(t)$ extends in a range around the geometrically determined progression of the reflected curve that is +/−10% of the value of the relative position of said leading edge $POS_{rel_VK}(t)$.

11. The fan wheel according to claim 1, wherein the progression of the relative position of said leading edge $POS_{rel_VK}(t)$, as a function of the relative unit radius t(r), satisfies the following condition:

$$POS_{rel_VK}(t) = \frac{-(A_1t^2 + A_2t)\cos[2\pi N(a(1-t)+1)(t+t_0)] + A_3t + A_4}{R_a - R_i}$$

where:

$t_0 \in [0; 0, 5]$

-continued $N \in [1; 8]$ $a \in [-1, 5; 1, 5]$ $A_1 \in [-10; 10]$ $A_2 \in [-10; 10]$ $A_3 \in [-10; 10]$ and $A_4 \in [-10; 10]$.

12. The fan wheel according to claim 1, wherein the progression of the relative position of said trailing edge $POS_{rel_HK}(t)$, as a function of the relative unit radius t(r), satisfies the following condition:

$$POS_{rel_HK}(t) = \frac{(A_1t^2 + A_2t)\cos[2\pi N(a(1-t)+1)(t+t_0)] + A_3t + A_4}{R_a - R_i}$$

where:

$t_0 \in [0; 0, 5]$ $N \in [1; 8]$ $a \in [-1, 5; 1, 5]$ $A_1 \in [-10; 10]$ $A_2 \in [-10; 10]$ $A_3 \in [-10; 10]$ and $A_4 \in [-10; 10]$.

13. The fan wheel according to claim 1 configured for a motor vehicle.

14. A radiator fan module, comprising:

a fan cowl formed with a fan wheel recess;

a cowl ring bounding said fan wheel recess;

a motor holder arranged within said fan wheel recess and mechanically connected with said fan cowl via struts;

a motor at least partially held in said motor holder; and a fan wheel according to claim 1 disposed in said fan wheel recess and to be rotationally driven by said motor.

15. The radiator fan module according to claim 14, wherein said motor is an electric motor.

16. The radiator fan module according to claim 14, wherein said struts are arranged in front of said fan wheel, relative to a flow direction.

17. A motor vehicle, comprising a radiator fan module according to claim 14.

* * * * *